United States Patent [19]

Grieb

[11] Patent Number: 4,874,287

[45] Date of Patent: Oct. 17, 1989

[54] VARIABLE-GEOMETRY TURBOCOMPRESSOR

[75] Inventor: Hubert Grieb, Unterpfaffenhofen, Fed. Rep. of Germany

[73] Assignee: MTU Motoren-und Turbinen-Union Munchen GmbH, Fed. Rep. of Germany

[21] Appl. No.: 17,459

[22] Filed: Feb. 24, 1987

[30] Foreign Application Priority Data

Feb. 28, 1986 [DE] Fed. Rep. of Germany ..... 3606595

[51] Int. Cl.[4] ..... F01D 17/12

[52] U.S. Cl. ..... 415/149.2; 415/155; 415/162

[58] Field of Search ..... 415/148, 149 R, 150, 415/155, 159, 162, 163, 164, 165, 160

[56] References Cited

U.S. PATENT DOCUMENTS

| | | | |
|---|---|---|---|
| 2,613,029 | 10/1952 | Wilde | 415/160 |
| 2,929,546 | 3/1960 | Wilkes, Jr. | 415/149 R |
| 3,588,270 | 6/1971 | Boelcs | 415/148 |
| 3,873,230 | 3/1975 | Norris et al. | 415/162 |
| 3,914,066 | 10/1975 | Downing | 415/149 R |
| 4,279,568 | 7/1981 | Munroe | 415/17 |
| 4,295,784 | 10/1981 | Manning | 415/162 |
| 4,558,987 | 12/1985 | Dittie | 415/162 |
| 4,652,208 | 3/1987 | Tameo | 415/162 |

FOREIGN PATENT DOCUMENTS

| | | | |
|---|---|---|---|
| 8812 | 6/1956 | Fed. Rep. of Germany | 415/163 |
| 2336317 | 2/1975 | Fed. Rep. of Germany | 415/163 |
| 2502986 | 7/1976 | Fed. Rep. of Germany . | |
| 3025753 | 1/1982 | Fed. Rep. of Germany . | |
| 2123831 | 9/1972 | France . | |

*Primary Examiner*—Robert E. Garrett
*Assistant Examiner*—John T. Kwon
*Attorney, Agent, or Firm*—Barnes & Thornburg

[57] ABSTRACT

A variable-geometry turbocompressor is provided which includes a tandem variable stator downstream of a rotor stage. The tandem stator includes an inlet stator cascade and an outlet stator cascade arranged adjacent one another and each including variable guide vanes. To accommodate precise control of the air flow over various compressor operating conditions, the inlet and outlet stator cascades are provided with adjusting mechanisms for varying the position of their vanes independently of one another.

16 Claims, 4 Drawing Sheets

VARIABLE-GEOMETRY TURBOCOMPRESSOR

Figure 1:
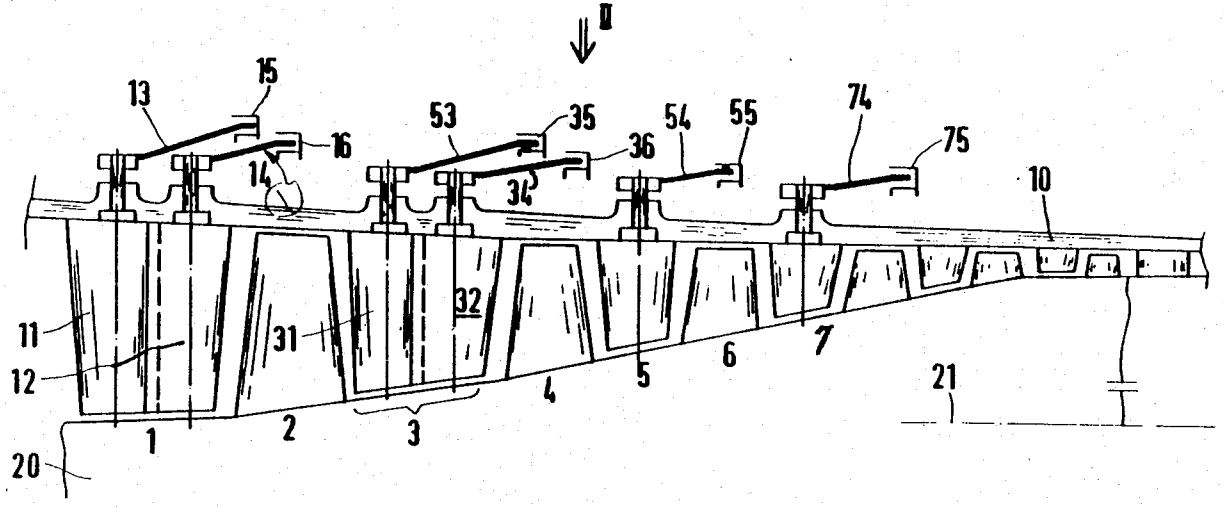

This invention relates to a variable-geometry turbocompressor having at least one variable inlet stator upstream of the first rotor stage.

A turbocompressor of said generic category is known form DE-OS 25 02 986. The variable inlet stator of this known arrangement exhibits two separate stator cascades arranged one downstream of the other (tandem construction) the vanes of which permit of separate pivotal variation. This serves to achieve the great amount of deflection of the gas stream and, thus, the great amount of preswirl required for certain operating regimes.

In a broad aspect of the present invention the off-design performance of a compressor forming part of a gas generator is improved to especially provide good adaptation to the following design and operating requirements:

compressors of high compression ratio with correspondingly high requirements for the adaptability of the forward stages to the greatly fluctuating air flow in the compressor inlet section.

Cooperation of the compressor with heat exchanger and mechanically independent, variable power turbine, compelling the compressor working line to be relatively high in the lower speed range to cater to the off-design performance of the gas turbine.

This requires that the airflow in the compressor inlet section and the rotational speed of the compressor be correlated; a requirement that cannot be achieved using an arrangement of the known type, i.e., a tandem inlet stator the inlet row of vanes of which is indeed variable separately from the outlet row of vanes, but only and invariably in the same direction and in a given relation to it.

It is a particular object of the present invention to provide a turbocompressor of said generic category, where the first rotor stage is directly followed by a variable stator which in conventional arrangement embraces two separate stator cascades essentially arranged one downstream of the other (tandem construction) and the separate inlet stator cascade of which is variable independently of the separate outlet stator cascade.

In a further aspect of the present invention the second or further rotor stages too are fitted at their downstream end with variable tandem stators the separate inlet stator cascade of which is variable independently of the separate outlet stator cascade.

The independence with which the separate inlet stator cascade(s) of the tandem stator(s) can be actuated permits excellent adaptation of the compressor to off-design operation of a gas generator and permits a safe surge margin to be achieved also in transient operation by suitable control provisions, while at normal operating conditions, maximum efficiency can be achieved with the aid of suitable control provisions. It is especially during acceleration of the gas generator, in the presence of pressure or temperature distortions at the inlet, of bleed air and/or mechanical power takeoffs that individual variability of the separate inlet stator cascade(s) ensures optimum adaptation of the compressor to the respective operating regime.

In a further aspect of the present invention the two-parameter actuation of the tandem stator(s)—other conditions remaining the same—enables the maximum allowable afflux angle to be widened by moderately closing the separate inlet stator cascade with the position of the separate outlet stator cascade remaining unchanged, and simultaneously, the maximum allowable aerodynamic load to be augmented and the stall margin to be widened by widening the gap between the inlet vanes and outlet vanes.

Two-parameter control ultimately affords more design latitude in the interest of improved aerodynamic load capacity of a compressor in steady-state operation, because individual actuation of the vanes in the inlet stator and the tandem stators permits the vane geometry to be optimized primarily for optimum efficiency at low surge margin and secondarily—with a different setting of the tandem stators—for, e.g., maximum surge margin or maximum insensitivity to inlet distortions.

In a further advantageous aspect of the present invention at least two further compressor stages downstream of the variable tandem stator(s) are fitted with variable single stator cascades, considering that when extending the actuating range of the forward stator, aerodynamically optimum correspondence of downstream stator cascades were prevented when these had fixed vanes. The inlet stator and the single stator cascades of the rotor stages downstream of the forward stages can then be actuated in response to the same actuating parameters as the separate outlet stator cascade(s) of the tandem stator(s).

In a further advantageous aspect of the present invention the separate inlet stator cascade of the tandem stator is connected to the separate outlet cascade such that codirectional actuation of these two cascades is in response to a first actuating parameter and that it is additionally variable by means of a higher-authority actuating element. This arrangement provides an advantage in that in many cases when the operating regime of the compressor or gas generator changes, only a single actuating motion will be required, so that in these cases the higher-authority actuating element does not need motivating.

A preferred version of a turbocompressor arranged in accordance with the present invention is characterized by a stator actuating mechanism having an actuating shroud for each row of vanes, pivotally connected to which shroud are the stator vanes by means of links, the shrouds themselves being rotatably variable by means of a central first actuating rod operated through an actuating element, and characterized in that a second actuating rod with a separate actuating element is provided for the separate inlet cascade of the tandem stator(s).

Coupling of the two actuating rods one with the other for codirectional actuation can be effected such that the two actuating rods are carried on the same pivotal axis and the actuating element of the second actuating rod is arranged on the first actuating rod. In an alternative arrangement both actuating elements are pivotally connected to the compressor casing, where if codirectional actuation of the two cascades through a first actuating element is desired, the actuating element for the second actuating rod is carried via a pivot that is fixedly arranged on the first actuating rod.

Figure 1A:
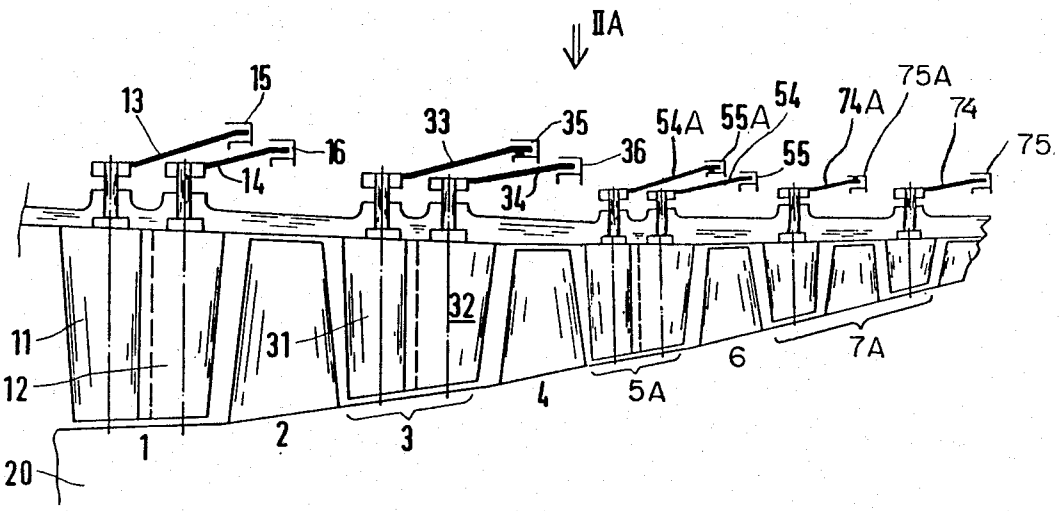
Figure 2:
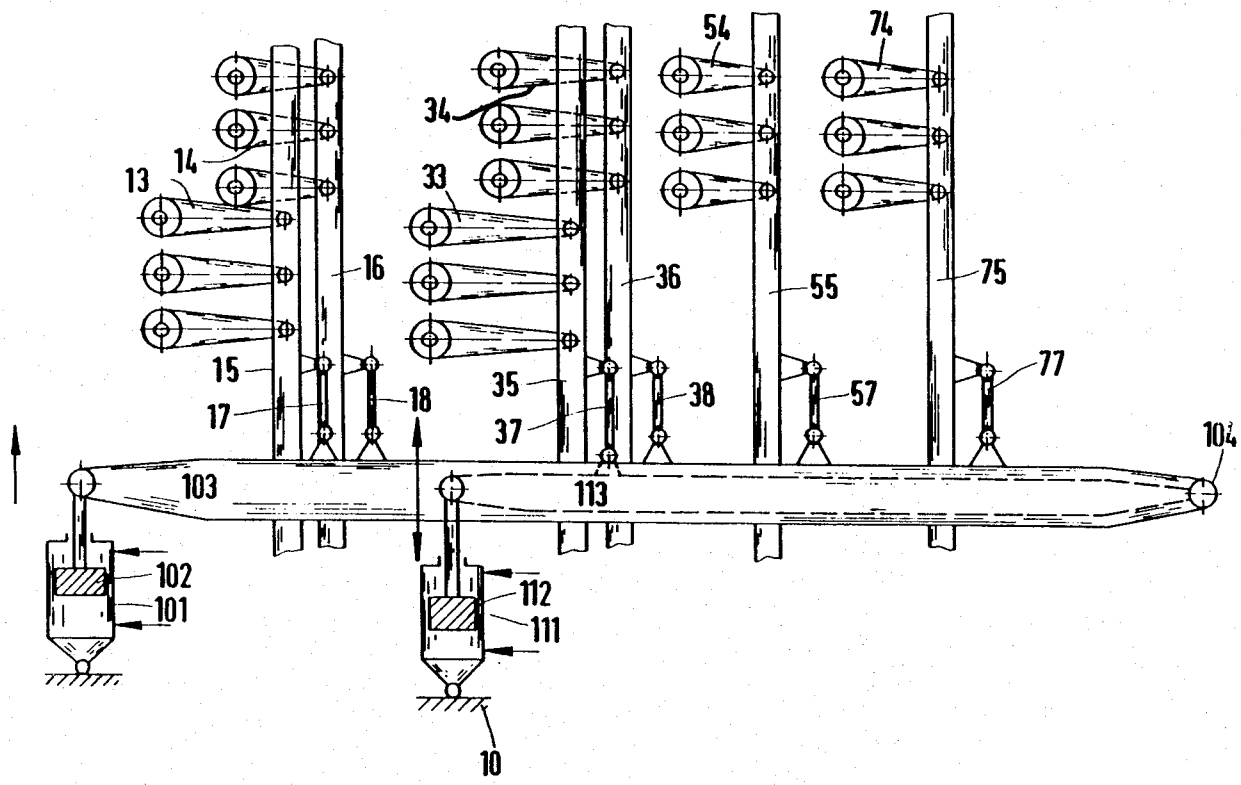
Figure 2A:
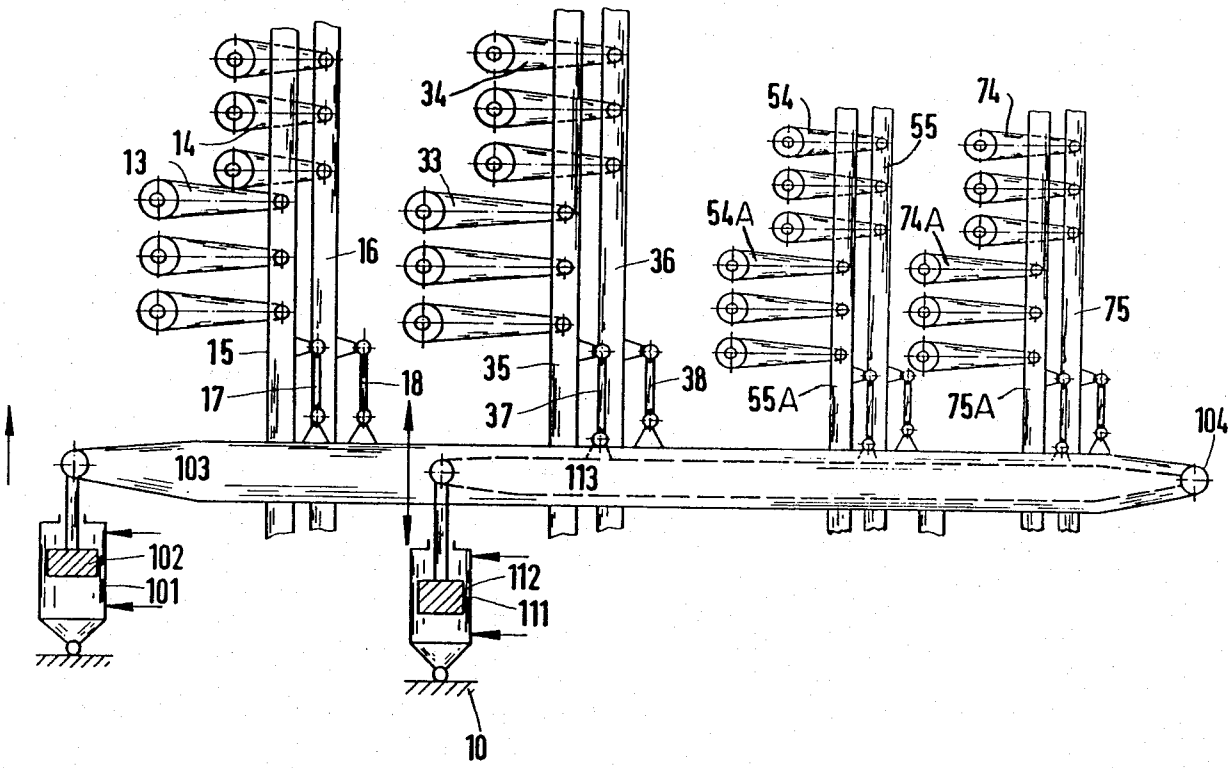

Embodiments of the turbocompressor arranged in accordance with the present invention are described more fully in light of the accompanying drawings, in which FIG. 1 is an axial sectional fragmentary view and illustrates a turbocompressor in schematic arrangement, FIG. 1A is a view similar to FIG. 1 showing a modified embodiment, FIG. 2 is a plan view on arrow II of the arrangement of FIG. 1, FIG. 2A plan view taken in direction of arrow IIA of the arrangement of FIG. 1A, FIG. 3 is a plan view in accordance with FIG. 2 and illustrates a second embodiment, and FIG. 4 is a plan view in accordance with FIG. 2 and illustrates a third embodiment.

The turbocompressor illustrated in FIG. 1 in an axial, fragmentary view has a rotor 20 and a compressor case 10. The axis of rotation of rotor 20 is indicated by the numeral 21. The first three stages of the rotor 20 are indicated by the numerals 2, 4 and 6. The first rotor stage 2 is preceded by an inlet stator 1 in tandem construction embracing the separate stator cascades 11, 12 one downstream of the other, and it is succeeded by a tandem stator 3 embracing a separate inlet stator cascade 31 and a separate outlet stator cascade 32. The second rotor stage 4 and the third rotor stage 6 are each succeeded by single but variable stator cascades 5 and 7. The various stator vanes of the separate stator cascades 11, 12 are connected to actuating shrouds 15, 16 through links 13, 14 such that rotation of the shrouds 15, 16 about the central axis 21 of the compressor produces pivotal movement of the vanes in the separate cascades 11, 12. The vanes in the separate stator cascades 31, 32 are similarly pivotally connected to the shrouds 35, 36 through links 33, 34; and the vanes in the variable stator cascades 5 and 7 to actuating shrouds 55, 75 through links 54, 74. The links 14, 34 are shorter than the links 13, 33, respectively, so that an approximately equal amount of rotation of the actuating shrouds 15, 16 and 35, 36, respectively, produce a wider pivotal movement of the respective separate outlet stator cascades 12, 32 referred to the pivotal movement of the separate inlet stator cascades 11, 31.

FIG. 2 shows the arrangement of FIG. 1 in plan view and illustrates a first actuating mode for rotating the actuating shrouds 15, 16, 35, 36, 55, 75. In this arrangement the actuating shrouds 15, 16, 36, 55 and 75 are pivotally connected to a first common actuating rod 103 through corresponding links 17, 18, 38, 57 and 77.

This actuating rod 103 is arranged for pivotal movement about a pivotal axis 104 and is pivotally moved by means of a piston 102 of an actuator 101. As it will be readily apparent the separate stator cascades 11, 12 of the inlet cascade 1, the separate outlet stator cascade 32 of the succeeding stator 3 and the single stator cascades 5 and 7 are all actuated codirectionally when the actuator 101 is operated. For the separate inlet stator cascade 31, a second actuating rod 113 with its own linear actuator 111 and actuating piston 112 is provided. The actuating shroud 35 of the separate stator cascade 31 is pivotally connected to the second actuating rod 113 through a link 37. While the second actuating rod 113 is carried on the same pivotal axis 104 as the first actuating rod 103, the two actuating rods are pivoted in complete independence of each other, which is achieved by dissimilar motivation of the actuators 101, 111. Both actuators are supported on the compressor casing 10.

Optionally arranged in lieu of the single downstream cascades 5, 7 following the rotor stages 4 and 6 are tandem stators of the same construction as downstream stator 3, in which case the inlet cascades of all downstream tandem stators are actuated by the second actuating rod 113.

This optional embodiment is depicted in FIGS. 1A and 2A, wherein like reference numerals as in FIGS. 1 and 2 are used for like structures. The second sets of stators and the adjusting mechanisms are depicted by the reference characters 54A, 55A, 74A and 75A.

As it will be readily apparent the embodiment in FIG. 3 differs from the basic embodiment in FIG. 2 by the actuating motion of the actuator 111 not being transmitted directly to the the second actuating rod 113, but via a pivot 105 fixedly arranged on the first actuating rod 103. Use of a bellcrank 106 between the piston rod of the piston 112 and the second actuating rod 113 supported on pivot 105 enables the second actuating rod 113 to go through an equally directed and almost equally wide pivotal movement as the same actuating rod 103. However, since the actuator 111 should on the other hand be driven independently of the actuator 101, the actuating shroud 35 and with it the separate inlet stator cascade 31 of the tandem stator 3 can still be actuated independently of the other variable stators. The advantage afforded by this embodiment is that a need to drive the actuator 111 exists only when a pronounced deviation of the actuating motion of the separate inlet stator cascade 31 of the tandem stator 3 from that of the remaining stators is required, whereas in the remaining operating cases the need to drive this actuator is eliminated.

This similarly applies to the further embodiment of the invention illustrated in FIG. 4. This embodiment differs from the second embodiment of FIG. 3 merely in that the actuator 111 is no longer pivotally connected to the compressor case 10 but is completely arranged on the first actuating rod 103. When the actuator 101 is operated, therefore, the second actuating rod 113 goes through the same pivotal motion as the first actuating rod 103. In this respect the actuation of all variable stators is in response to a single parameter. It is only when a deviation from one-parameter actuation is desired for the separate inlet stator cascade 31 of the tandem stator 3 that the actuator 111 is motivated, which in turn is connected to the second actuating rod 113 through a bellcrank 106. In this manner the position of the separate inlet stator cascade 31 of the tandem stator 3 can be adjusted independently of the other variable stators.

What is claimed is:

1. Variable-geometry turbocompressor for compressing a fluid stream having at least one variable compressor inlet stator preceding a first compressor rotor stage, wherein the first compressor rotor stage is directly followed in a compressing flow direction by a first variable stator which includes separate inlet and outlet stator cascades arranged one downstream of the other in tandem construction and wherein the separate inlet stator cascade is adjusted variably and independently of the separate outlet stator cascade so that a compressed fluid stream which exits the first compressor rotor stage is adjustably deflected.

2. Turbocompressor of claim 1, wherein a second compressor rotor stage is provided downstream of the first variable stator and wherein at a respective downstream end of said second compressor stage there is a second variable tandem stator comprising a second separate inlet stator cascade which is variable independently of a second and separate outlet stator cascade.

3. Turbocompressor of claim 2, wherein at least two subsequent compressor rotor stages with downstream variable single stator cascades are provided downstream of the second variable tandem stator.

4. Turbocompressor of claim 3, wherein the one variable compressor inlet stator and the variable single stator cascades of the subsequent compressor rotor stages following the first and second compressor rotor are varied in accordance with identical actuating parameters as the separate outlet stator cascades of the two variable tandem stators.

5. Turbocompressor of claim 4, wherein the first separate inlet stator cascade of the first variable tandem stator is connected to the separate outlet stator cascade of the first variable tandem stator such that codirectional actuation of these two cascades is effected in response to a first actuating parameter and wherein the separate outlet stator of said first variable tandem stator is additionally variable in response to a second actuating parameter by means of a higher-authority actuating element.

6. Turbocompressor having at least one variable inlet stator preceding a first compressor rotor stage, wherein the first compressor rotor stage is directly followed by a variable stator which includes separate inlet and outlet compressor stator cascades arranged one downstream of the other in tandem construction, and wherein the separate inlet compressor stator cascade is variable independently of the separate outlet compression stator cascade, wherein in addition to the variable tandem stator with independently variable inlet and outlet separate stator cascades, at least two subsequent compressor rotor stages are provided downstream of the first compressor rotor stage and each subsequent compression rotor stage having a variable single stator cascade, each stator cascade comprising a row of vanes, wherein means are provided for adjusting the stator cascades comprising an actuating shroud for each row of vanes and pivotally connected to the vanes by means of links and wherein, except for the inlet cascade of the first tandem compressor stator cascade blades, each of the actuating shrouds for the compressor stator cascade blades in turn are rotatably positioned by a central first actuating rod operated by means of an actuating element and wherein a second actuating rod having a separate actuating element is provided for the separate inlet stator cascade of the first tandem compressor stator blade.

7. Turbocompressor of claim 6, wherein the separate actuating element for the second actuating rod is arranged on the first actuating rod.

8. Turbocompressor of claim 6, wherein both actuating elements are pivotally connected to a compressor casing.

9. Turbocompressor of claim 8, wherein actuating motion of the separate actuating element for the second actuating rod is obtained through a pivot fixedly arranged on the first actuating rod.

10. Variable-geometry turbocompressor for compressing a fluid stream comprising:

a first compressor rotor stage;

a tandem variable inlet stator arranged immediately downstream of the first compressor rotor stage, said tandem stator including an inlet stator cascade and an outlet stator cascade and adjusting means for varying the inlet and outlet stator cascades independently of one another so that the inlet and outlet stator cascades adjustably deflect a compressed fluid stream as it exits the first compressor rotor stage.

11. Turbocompressor according to claim 10, wherein said adjusting means includes an inlet stator actuator shroud pivotally connected to guide vanes of the inlet stator cascade, an outlet stator actuator shroud pivotally connected to guide vanes of the outlet stator cascade, an inlet stator actuator rod for rotating the inlet stator actuator shroud, an outlet stator actuator rod for rotating the outlet stator actuator shroud, and separately operable actuating elements for imparting movement to the inlet stator and outlet stator actuating rods.

12. Turbocompressor according to claim 10, further comprising:

a second compressor rotor stage arranged downstream of the tandem variable stator, and a second tandem variable stator arranged immediately downstream of the second compressor rotor stage, said second tandem stator including an inlet stator cascade and an outlet stator cascade and adjusting means for varying the inlet and outlet stator cascades of the second tandem stator independently of one another.

13. Turbocompressor according to claim 12, further comprising at least two subsequent compressor stages arranged downstream of said second rotor stage and second tandem stator, said subsequent compressor stages including compressor rotors and variable single stator cascades.

14. Turbocompressor according to claim 12, wherein the respective stator cascades of the subsequent compressor stages are linked to operate together with the adjusting means for the inlet stator cascade of the tandem stator.

15. Turbocompressor according to claim 10, further comprising at least two subsequent compressor stages arranged downstream of said tandem variable stator, said subsequent compressor stages including compressor rotors and variable single stator cascades.

16. Turbocompressor according to claim 15, wherein the respective stator cascades of the subsequent compressor stages are linked to operate together with the adjusting means for the inlet stator cascade of the tandem stator.

* * * * *